US010287660B2

(12) United States Patent
Sakamoto et al.

(10) Patent No.: US 10,287,660 B2
(45) Date of Patent: May 14, 2019

(54) STEEL WIRE ROD FOR BEARINGS HAVING EXCELLENT DRAWABILITY AND COIL FORMABILITY AFTER DRAWING

(71) Applicant: NIPPON STEEL & SUMITOMO METAL CORPORATION, Tokyo (JP)

(72) Inventors: Masashi Sakamoto, Kamaishi (JP); Junichi Kodama, Kamaishi (JP); Kenichi Nakamura, Kimitsu (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 193 days.

(21) Appl. No.: 15/519,592

(22) PCT Filed: Oct. 20, 2015

(86) PCT No.: PCT/JP2015/079550

§ 371 (c)(1),
(2) Date: Apr. 17, 2017

(87) PCT Pub. No.: WO2016/063867

PCT Pub. Date: Apr. 28, 2016

(65) Prior Publication Data

US 2017/0241001 A1 Aug. 24, 2017

(30) Foreign Application Priority Data

Oct. 20, 2014 (JP) ..... 2014-213479

(51) Int. Cl.

| | |
|---|---|
| ***C22C 38/34*** | (2006.01) |
| ***C22C 38/32*** | (2006.01) |
| ***C22C 38/00*** | (2006.01) |
| ***C22C 38/02*** | (2006.01) |
| ***C22C 38/04*** | (2006.01) |

(Continued)

(52) U.S. Cl.

CPC ..... *C22C 38/32* (2013.01); *C21D 9/46* (2013.01); *C22C 38/00* (2013.01); *C22C 38/001* (2013.01);

(Continued)

(58) Field of Classification Search

None

See application file for complete search history.

(56) References Cited

U.S. PATENT DOCUMENTS

2007/0187003 A1 8/2007 Takashima et al.
2011/0284139 A1 11/2011 Nishida et al.

(Continued)

FOREIGN PATENT DOCUMENTS

JP 8-260046-AA 10/1996
JP 2000-337334 A 12/2000

(Continued)

OTHER PUBLICATIONS

International Search Report for PCT/JP2015/079550 dated Jan. 12, 2016.

(Continued)

*Primary Examiner* — Shawn Mckinnon
*Assistant Examiner* — Lashawnda T McKinnon
(74) *Attorney, Agent, or Firm* — Birch, Stewart, Kolasch & Birch, LLP

(57) ABSTRACT

A steel wire rod includes, in terms of mass %, 0.95-1.10% C, 0.10-0.70% Si, 0.20-1.20% Mn, 0.90-1.60% Cr, 0-0.25% Mo, 0-25 ppm B, 0-0.020% P, 0-0.020% S, 0-0.0010% O, 0-0.030% N, and 0.010-0.100% Al. In a surface area of the steel wire rod, the Vickers hardness is HV 300 to HV 420, the area ratio of pearlite is 80% or more, and the area ratio of pro-eutectoid cementite is 2.0% or less. In an inner area of the steel wire rod, the area ratio of pearlite is 90% or more, and the area ratio of pro-eutectoid cementite is 5.0% or less. In the steel wire rod, the area ratio of pearlite blocks having an equivalent circle diameter of more than 40 μm is 0.62% or less, and the difference in Vickers hardness between the surface area and a center portion is HV 20.0 or less.

4 Claims, 5 Drawing Sheets

(51) Int. Cl.

| | |
|---|---|
| ***C22C 38/06*** | (2006.01) |
| ***C22C 38/22*** | (2006.01) |
| ***C21D 9/46*** | (2006.01) |
| ***C22C 38/18*** | (2006.01) |
| *B21B 1/16* | (2006.01) |
| *B21B 3/00* | (2006.01) |
| *C21D 8/06* | (2006.01) |

(52) U.S. Cl.

CPC ..... *C22C 38/002* (2013.01); *C22C 38/02* (2013.01); *C22C 38/04* (2013.01); *C22C 38/06* (2013.01); *C22C 38/18* (2013.01); *C22C 38/22* (2013.01); *B21B 1/16* (2013.01); *B21B 3/00* (2013.01); *C21D 8/06* (2013.01)

(56) References Cited

U.S. PATENT DOCUMENTS

| | | | |
|---|---|---|---|
| 2012/0118443 | A1 | 5/2012 | Lee et al. |
| 2015/0167112 | A1 | 6/2015 | Sakamoto et al. |

FOREIGN PATENT DOCUMENTS

| | | | |
|---|---|---|---|
| JP | 2000-345294 | A | 12/2000 |
| JP | 2001-234286 | A | 8/2001 |
| JP | 2003-49226 | A | 2/2003 |
| JP | 2003-129176 | A | 5/2003 |
| JP | 2003-171737 | A | 6/2003 |
| JP | 2004-100016 | A | 4/2004 |
| JP | 2005-281860 | A | 10/2005 |
| JP | 2006-200039 | A | 8/2006 |
| JP | 2008-7856 | A | 1/2008 |
| JP | 2012-233254 | A | 11/2012 |
| WO | 2013/094475 | A1 | 12/2000 |
| WO | WO 2013/108828 | A1 | 7/2013 |

OTHER PUBLICATIONS

Written Opinion of the International Searching Authority for PCT/JP2015/079550 (PCT/ISA/237) dated Jan. 12, 2016.

Extended European Search Report dated Mar. 9, 2018, issued in European Patent Application No. 15852546.9.

STEEL WIRE ROD FOR BEARINGS HAVING EXCELLENT DRAWABILITY AND COIL FORMABILITY AFTER DRAWING

TECHNICAL FIELD OF THE INVENTION

The present invention relates to a steel wire rod for bearings having excellent drawability without being subjected to a spheroidizing process after being hot rolled and excellent coil formability after drawing.

Priority is claimed on Japanese Patent Application No. 2014-213479, filed Oct. 20, 2014, the content of which is incorporated herein by reference.

RELATED ART

A steel wire rod for bearings is used as a starting material for bearing parts such as a steel ball of a ball bearing and a roller of a roller bearing. In a common method of manufacturing the bearing parts, spheroidizing annealing or the like is performed before drawing. In addition, in some bearing parts having a small diameter, even when spheroidizing annealing is performed, a drawn wire is broken as a result of work hardening due to drawing, and therefore an additional annealing is performed between drawing steps.

A bearing steel specified by JIS G 4805 is a hypereutectoid steel having an amount of C more than the amount of C at the eutectoid point, and includes Cr. Therefore, pro-eutectoid cementite or martensite is present in normal steel wire rods, and the drawability of the steel wire rods is significantly low. As a result, spheroidizing annealing is performed before drawing at present in order to improve the drawability. However, spheroidizing annealing impairs the production efficiency, and adds an extra cost. In recent years, a steel wire rod for bearings having excellent drawability as hot-rolled has been desired in order to reduce costs by omitting spheroidizing annealing.

In addition, a wire drawn as hot-rolled has high strength, and thereby it is difficult to form a product shape. As a result, it is necessary to apply a heat treatment to the drawn wire. The heat treatment requires that the drawn wire is formed into a coil. Therefore, it is important for the drawn wire to have a formability to be formed into a coil after drawing.

In a high-carbon steel wire rod disclosed in Patent Document 1, the drawability is improved by reducing the average grain size of ferrite to 20 μm or smaller and the maximum grain size of ferrite to 120 μm or smaller. However, Patent Document 1 is not aimed at omitting spheroidizing annealing, and does not study cases in which a large amount of Cr is added to the steel wire rod technically. An investigation by the present inventors shows that the steel wire rod does not have sufficient drawability even when the maximum grain size is limited to 120 μm or smaller.

Patent Document 2 suggests refining pearlite colonies and increasing the amount of pro-eutectoid cementite in order to improve the drawability of a wire rod. However, an investigation by the present inventors shows that the wire rod does not have sufficient drawability even when pearlite colonies are refined. In addition, a large amount of fine pro-eutectoid cementite is dispersed as a requirement in Patent Document 2. However, an investigation by the present inventors shows that drawability decreases when an excessive amount of pro-eutectoid cementite precipitate.

In addition, in Patent Document 3, the average size of areas enclosed by pro-eutectoid cementite is limited to 20 μm or smaller in order to improve drawability. However, an investigation by the present inventors shows that the drawability is not necessarily improved even when areas enclosed by pro-eutectoid cementite are refined. Patent Document 3 also suggests positive precipitation of pro-eutectoid cementite in a similar manner to Patent Document 2.

Furthermore, in Patent Document 4, the area ratio of pro-eutectoid cementite is enlarged to 3% or more, and the lamellar spacing is limited to 0.15 μm or smaller in order to improve the drawability. However, an investigation by the present inventors shows that an excessively small lamellar spacing increases the strength of the wire rod excessively, and thereby the life of dies decreases since a heavy load is applied to a machine or dies.

In Patent Document 5 and Patent Document 6, pro-eutectoid cementite is inhibited from forming and the size of pro-eutectoid cementite is restricted by a rapid cooling after hot-rolling in order to improve drawability. An investigation by the present inventors also shows that the drawability is improved by reducing the amount and the size of pro-eutectoid cementite. However, the present inventors found new problems including that the hardness of a wire rod increases in a surface area as the transformation temperature decreases, and thereby a wire breaking occurs when the wire is formed into a coil after drawing, even when the formation of pro-eutectoid cementite is inhibited by a rapid cooling as disclosed in Patent Document 5 and Patent Document 6.

In Patent Document 7, the drawability is improved by controlling the strength of a wire rod while inhibiting the formation of pro-eutectoid cementite. However, the present inventors found new problems including that when the formation of pro-eutectoid cementite is inhibited by cooling at a constant cooling rate as disclosed in Patent Document 7, the hardness of a wire rod increases in a surface area, the difference in hardness between the surface area and a center portion increases, and thereby the wire breaking occurs when the wire is formed into a coil.

Patent Document 8 discloses a method for manufacturing a wire rod having a hardness of HRC 30 or lower so that the wire rod can be drawn as hot-rolled. However, Patent Document 8 does not disclose components in bearing steel. It is difficult to obtain a pearlite structure having a hardness of HRC 30 or lower from chemical components of bearing steel disclosed in JIS G 4805, and the wire rod did not have sufficient drawability because of the formation of abnormal structures or the like even when the hardness of the wire rod was HRC 30 or lower.

Patent Document 9 discloses a wire rod having a small ferrite size and a large amount of Cr in carbides. In the wire rod disclosed in Patent Document 9, the time required for spheroidizing annealing is reduced by accelerating the spheroidizing of carbides during spheroidizing annealing. Thus, spheroidizing annealing is indispensable to the wire rod disclosed in Patent Document 9, and sufficient drawability cannot be imparted to the wire rod without spheroidizing annealing.

PRIOR ART DOCUMENT

Patent Document

[Patent Document 1] Japanese Unexamined Patent Application, First Publication No. 2006-200039

[Patent Document 2] Japanese Unexamined Patent Application, First Publication No. 2004-100016

[Patent Document 3] Japanese Unexamined Patent Application, First Publication No. 2003-129176

[Patent Document 4] Japanese Unexamined Patent Application, First Publication No. 2003-171737

[Patent Document 5] Japanese Unexamined Patent Application, First Publication No. H08-260046

[Patent Document 6] Japanese Unexamined Patent Application, First Publication No. 2001-234286

[Patent Document 7] Pamphlet of International Publication No. WO2013/108828

[Patent Document 8] Japanese Unexamined Patent Application, First Publication No. 2003-49226

[Patent Document 9] Japanese Unexamined Patent Application, First Publication No. 2012-233254

DISCLOSURE OF THE INVENTION

Problems to be Solved by the Invention

The present invention was made as a solution to the above-described problems, and an object thereof is to provide a steel wire rod for bearings having high drawability capable of omitting an annealing before drawing and high coil formability after drawing.

Means for Solving the Problem

The present inventors investigated the effect of the microstructure and internal hardness of a steel wire rod for bearings on drawability and coil formability after drawing in detail. As a result, the present inventors found that though an excessive precipitation of pro-eutectoid cementite decreases the drawability of the wire rod, the hardness of the wire rod increases in a surface area and the coil formability of the wire rod after drawing decreases when the precipitation of pro-eutectoid cementite is inhibited excessively. In addition, the present inventors found that the drawability can be improved by reducing the size of pearlite blocks or the like even when a small amount of pro-eutectoid cementite precipitates. As a result, the present inventors found that it is important to decrease the size of pearlite blocks and to restrict the precipitation of pro-eutectoid cementite in order to prevent a wire from breaking because of internal cracks appearing during drawing. In addition, the present inventors found that it is important to reduce the difference in hardness between a surface area and a center portion, and the amount of pro-eutectoid cementite in the surface area as well as to control the hardness in the surface area when a wire after drawing is formed into a coil. Thus, the present inventors completed the present invention based on the findings.

The present invention is completed on the basis of the above-described findings. The outline of the present invention is as follows.

(1) According to an aspect of the present invention, a steel wire rod includes C: 0.95 to 1.10 mass %, Si: 0.10 to 0.70 mass %, Mn: 0.20 to 1.20 mass %, Cr: 0.90 to 1.60 mass %, Mo: 0 to 0.25 mass %, B: 0 to 25 ppm, P: 0 to 0.020 mass %, S: 0 to 0.020 mass %, O: 0 to 0.0010 mass %, N: 0 to 0.030 mass %, Al: 0.010 to 0.100 mass %, and a balance: Fe and impurities. In the steel wire rod, a surface area is the area between a surface and a line 0.1 times a half of an equivalent circle diameter of the steel wire rod apart from the surface in a cross-section perpendicular to a longitudinal direction, and has a microstructure consisting of pearlite, pro-eutectoid cementite, and the balance. In the surface area, the Vickers hardness is HV 300 to 420, the area ratio of pearlite is 80% or more, the area ratio of pro-eutectoid cementite is 2.0% or less, and the balance is one or more selected from the group consisting of ferrite, spheroidal cementite, and bainite. In the steel wire rod, an inner area is the area enclosed by the line 0.1 times the half of the equivalent circle diameter of the wire rod apart from the surface and including a center in the cross-section perpendicular to the longitudinal direction, and has a microstructure consisting of pearlite, pro-eutectoid cementite, and the balance. In the inner area, the area ratio of pearlite is 90% or more, the area ratio of pro-eutectoid cementite is 5.0% or less, the balance is one or more selected from the group consisting of ferrite, spheroidal cementite, and bainite, and the area ratio of pearlite blocks existing in pearlite and having an equivalent circle diameter of more than 40 μm is 0.62% or less. In the wire rod, a center portion is the area enclosed by a line 0.5 times the half of the equivalent circle diameter of the steel wire rod apart from the center and including the center in the cross-section perpendicular to the longitudinal direction, and the difference between the Vickers hardness of the center portion and the Vickers hardness of the surface area is HV 20.0 or less.

(2) The wire rod according to the above (1) may further include at least one selected from the group consisting of: Mo: 0.05 to 0.25 mass %, and B: 1 to 25 ppm.

(3) In the wire rod according to the above (1) or (2), the diameter of the steel wire rod may be 3.5 mm to 5.5 mm.

Effects of the Invention

Since the steel wire rod for bearings according to the above-described aspect of the present invention has high drawability by which an annealing treatment can be omitted before drawing, and high coil formability after drawing, it is possible to omit a lot of steps for manufacturing bearing parts without affecting the yield of the bearing parts, and to stably manufacture good bearing parts while reducing the energy consumption and costs drastically.

Moreover, the steel wire rod for bearings according to the above-described aspect of the present invention has a sufficient hardenability necessary for a surface hardening of bearing parts, and thereby it is possible to produce bearing parts having an excellent surface hardness.

EMBODIMENTS OF THE INVENTION

Figure 1:
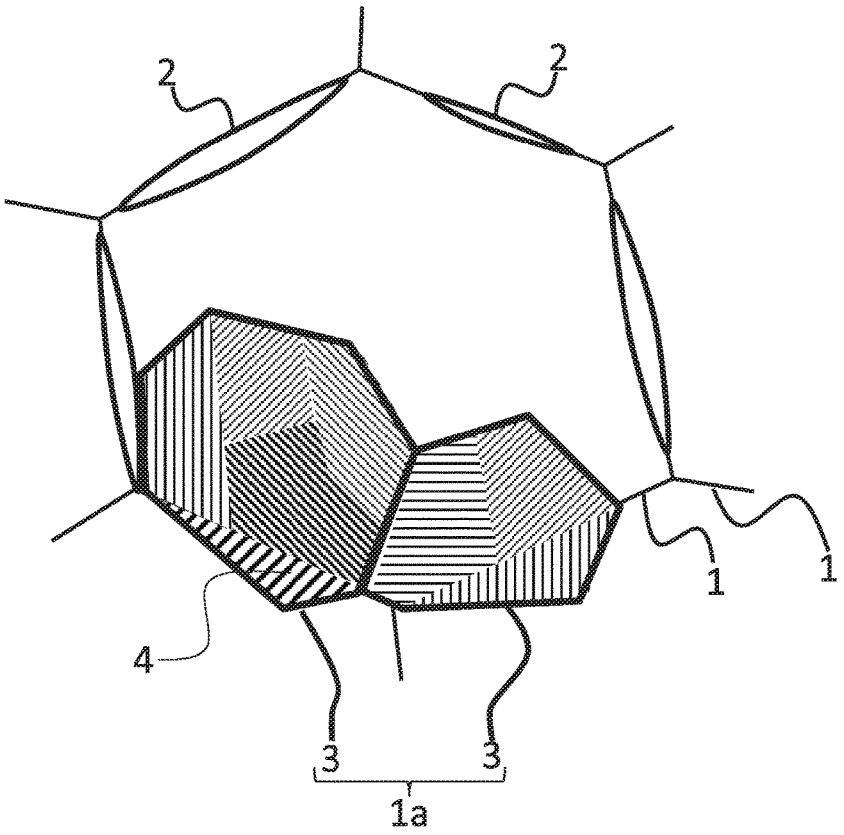
FIG. 1 is a schematic view of a microstructure mainly including pearlite in a hypereutectoid steel.

Hereinafter, a steel wire rod for bearings having excellent drawability and excellent coil formability after drawing according to an embodiment of the present invention will be described. Since the embodiment is merely described in detail in order to afford a better understanding of the point of the present invention, the present invention is not limited by the embodiment unless otherwise specified.

First of all, the steel composition of a wire rod according to the embodiment will be described. Hereinafter, % and ppm regarding units of amounts of chemical elements mean mass % and mass ppm, respectively.

C: 0.95-1.10%

C is indispensable for imparting required strength to steel for bearings.

Therefore, it is necessary that the amount of C be 0.95% or more. The amount of C is preferably 0.98% or more, and more preferably more than 1.00% in order to further enhance the strength of bearing parts which are manufactured from steel for bearings. When the amount of C is more than 1.10%, it is difficult to inhibit the precipitation of pro-eutectoid cementite in a cooling step after hot rolling, and thereby the drawability and coil formability are degraded. Therefore, it is necessary that the amount of C be 1.10% or less. The amount of C is preferably 1.08% or less, and more preferably less than 1.05% in order to ensure stably the drawability and coil formability.

Si: 0.10-0.70%

Si is useful as a deoxidizer, and inhibits pro-eutectoid cementite from precipitating without decreasing the amount of carbon. In addition, Si increases the strength of ferrite in pearlite. Therefore, it is necessary that the amount of Si be 0.10% or more. The amount of Si is preferably 0.12% or more or 0.15% or more, and more preferably more than 0.20% in order to impart more stable strength and drawability to steel bearing parts. However, when steel includes an excessive amount of Si, inclusions containing $SiO_2$, which cause harm to the drawability of a wire rod and the product characteristics of bearing parts, tend to form, and an excessive increase in strength decreases the coil formability. Therefore, it is necessary that the upper limit of the amount of Si be 0.70%. The amount of Si is preferably 0.50% or less, and more preferably 0.30% or less or 0.25% or less in order to further enhance the drawability and coil formability.

Mn: 0.20-1.20%

Mn is useful not only for deoxidation and desulfurization, but also for securing the hardenability of steel. Therefore, it is necessary that the amount of Mn be 0.20% or more. The amount of Mn is preferably 0.23% or more, and more preferably more than 0.25% in order to further enhance the hardenability. However, when steel includes an excessive amount of Mn, it wastes money because the above-described effects of Mn have been maximized. Furthermore, supercooled structures such as martensite tend to form in a cooling step after hot rolling, and cause harm to the drawability. Therefore, it is necessary that the upper limit of the amount of Mn be 1.20%. The amount of Mn is preferably 1.00% or less, and more preferably 0.80% or less or less than 0.50%.

Cr: 0.90-1.60%

Cr heightens the hardenability, and accelerates spheroidizing during a heat treatment of a drawn wire and increases the amount of carbides. In addition, Cr is highly effective at inhibiting the size of pearlite blocks from increasing during slow cooling after rolling. However, when the amount of Cr is less than 0.90%, Cr does not produce the above-described effects sufficiently, and thereby the product characteristics of bearing parts decreases. Therefore, it is necessary that the amount of Cr be 0.90% or more. The amount of Cr is preferably more than 1.00% or 1.10% or more, and more preferably 1.20% or more or 1.30% or more in order to obtain a higher hardenability. On the other hand, when the amount of Cr is more than 1.60%, the hardenability is excessive, and supercooled structures such as martensite and bainite tend to form in a cooling step after hot rolling. Therefore, it is necessary that the upper limit of the amount of Cr be 1.60%. The amount of Cr is preferably less than 1.50%, and more preferably 1.40% or less in order to secure more stable drawability.

P: 0-0.020%

P is an impurity. When the amount of P is more than 0.020%, the drawability of a wire rod may be degraded by the segregation of P in grain boundaries. Therefore, it is preferable to limit the amount of P to 0.020% or less. More preferably, the amount of P may be limited to 0.015% or less. In addition, it is desirable to decrease the amount of P as much as possible, and therefore the lower limit of the amount of P may be 0%. However, it is not technically easy to reduce the amount of P to 0%. In addition, when the amount of P is consistently limited to less than 0.001%, the cost of steelmaking is high. Thus, the lower limit of the amount of P may be 0.001%.

S: 0-0.020%

S is an impurity. When the amount of S is more than 0.020%, the drawability of a wire rod may be degraded by the formation of a large size of MnS. Therefore, it is preferable to limit the amount of S to 0.020% or less. More preferably, the amount of S may be limited to 0.015% or less. In addition, it is desirable to decrease the amount of S as much as possible, and therefore the lower limit of the amount of S may be 0%. However, it is not technically easy to reduce the amount of S to 0%. In addition, when the amount of S is consistently reduced to less than 0.001%, the cost of steelmaking is high. Thus, the lower limit of the amount of S may be 0.001%.

Mo: 0-0.25%

Mo is highly effective at heightening the hardenability, and it is preferable that steel include Mo as an optional chemical element. However, when the amount of Mo is more than 0.25%, the hardenability is excessive, and supercooled structures such as martensite and bainite tend to form in a cooling step after hot rolling. Therefore, it is necessary that the upper limit of the amount of Mo be 0.25%. If steel includes Mo, the amount of Mo may be 0.23% or less or less than 0.20% in order to more consistently secure the drawability. The lower limit of the amount of Mo may be 0%, and the amount of Mo may be 0.05% or more in order to further enhance the hardenability.

B: 0-25 ppm (0-0.0025%)

B inhibits degenerated pearlite and bainite from forming by the concentration of solute B in grain boundaries. However, when steel includes an excessive amount of B, carbides such as $Fe_{23}(CB)_6$ forms in a structure (austenite in a high temperature, that is, prior austenite), and thereby the product characteristics of bearing parts decreases. Therefore, it is necessary that the upper limit of the amount of B be 25 ppm. In order to inhibit formation of degenerated pearlite and bainite, and ensure more stable drawability and coil formability, B is an optional chemical element, and the lower limit of the amount of B may be 0 ppm (0%). The amount of B may be 1 ppm (0.0001%) or more, 2 ppm (0.0002%) or more, or 5 ppm (0.0005%) or more.

O: 0-0.0010%

O is an impurity. When the amount of O is more than 0.0010%, oxide-based inclusions form, and the drawability of a wire rod and the product characteristics of bearing parts deteriorate. Therefore, the amount of O is limited to 0.0010% or less. It is desirable to decrease the amount of O as much as possible, and therefore the above-described range limitation includes 0%. However, it is not technically easy to reduce the amount of O to 0%. Therefore, the lower limit of the amount of O may be 0.0001% in view of the cost of steelmaking. If considering practical operating conditions, it is preferable that the amount of O be 0.0005% to 0.0010%.

N: 0-0.030%

N is an impurity. When the amount of N is more than 0.030%, large size inclusions form, and the drawability of a wire rod and the product characteristics of bearing parts deteriorate. Therefore, the amount of N is 0.030% or less. N combines with Al or B to form nitrides, and the nitrides reduce the size of crystal grains by acting as pinning particles. Therefore, when the amount of N is small, steel may include N. For example, the lower limit of the amount of N may be 0.003%. The lower limit of the amount of N may be 0.005% in order to further enhance the effect of N on grain refining.

Al: 0.010-0.100%

Al is a deoxidizing element. When the amount of Al is less than 0.010%, the drawability of a wire rod and the product characteristics of bearing parts deteriorate because oxides precipitate as a result of insufficient deoxidation. When the amount of Al is more than 0.100%, $Al_2O_3$-based inclusions form, and thereby the drawability of a wire rod and the product characteristics of bearing parts deteriorate. Therefore, the amount of Al is 0.010% to 0.100%. It is preferable that the amount of Al be 0.015% to 0.078% in order to prevent the drawability and the quality of products from deteriorating more reliably. More preferably, the amount of Al may be 0.018% to 0.050%.

Though steel may include chemical elements other than the above-described chemical elements as impurities, the amounts of such impurities are limited in the manner described in JIS G 4805. That is, the amount of Cu is limited to 0.20% or less, and the amounts of elements other than the above-described elements are limited to 0.25% or less.

Steel according to an embodiment of the present invention consists of C, Si, Mn, Cr, and the balance of Fe and impurities. The steel according to the embodiment may include at least one chemical element selected from the group consisting of Mo and B. Therefore, steel according another embodiment of the present invention consists of C, Si, Mn, Cr, at least one selected from the group consisting of Mo and B as optional chemical elements, and the balance of Fe and impurities. The steel according to the embodiments is classified as hypereutectoid steel according to the amounts of essential elements, and may include P, S, O, N, Al, and the like as impurities.

Next, the microstructure of a steel wire rod according to the embodiment will be described.

Figure 2A:
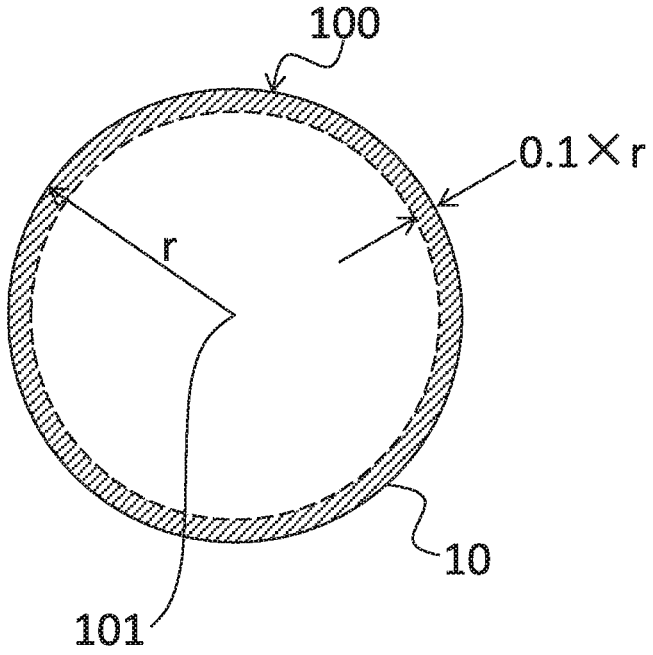
FIG. 2A is a schematic view showing a surface area.
Figure 2B:
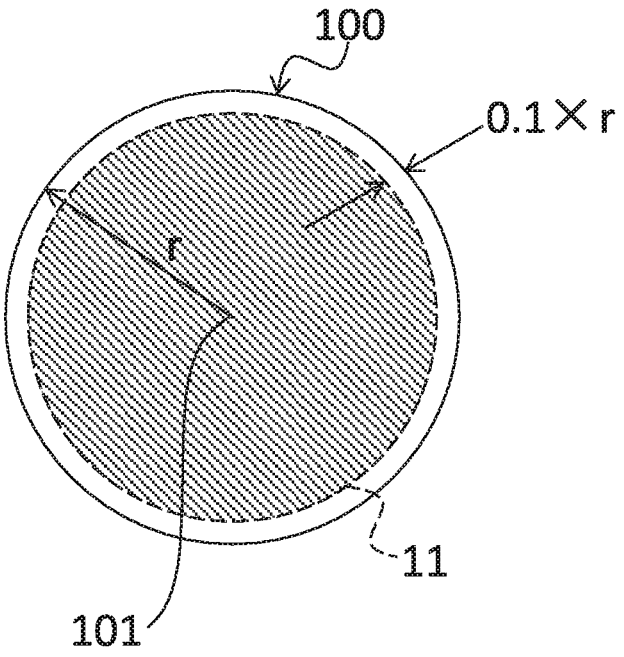
FIG. 2B is a schematic view showing an inner area.
Figure 2C:
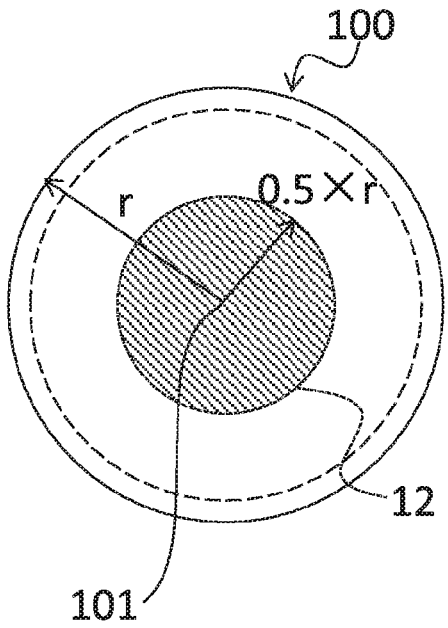
FIG. 2C is a schematic view showing a center portion.
Figure 2D:
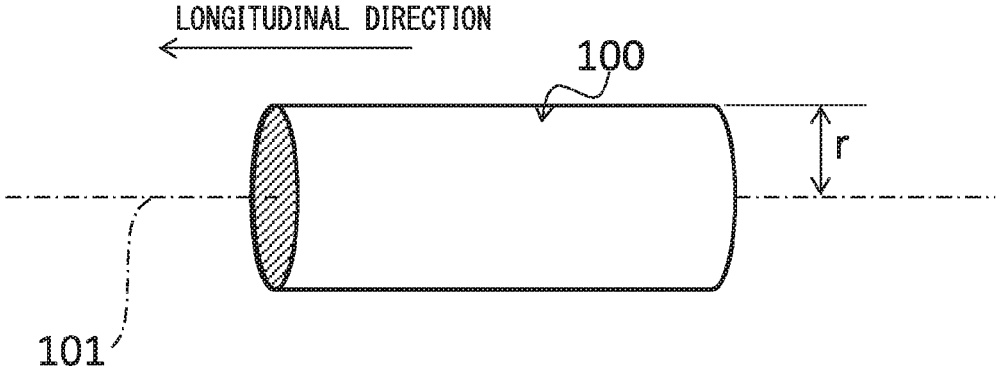
FIG. 2D is a view showing a C cross section of a wire rod.

In the present invention, in a C cross section as shown in FIG. 2A, a "surface area" 10 is defined as an area (hatched area) from a surface 100 of a wire rod to a depth 0.1×r (mm) (r: radius of the steel wire rod (the half of equivalent circle diameter)). As shown in FIG. 2B, an "inner area" 11 is defined as an area (hatched area) inside the surface area 10 with the exception of the surface area 10. That is, when the radius of the steel wire rod (the half of equivalent circle diameter) is r (mm), the surface area 10 is an area between the surface 100 of the steel wire rod and a boundary (line in the C cross section) a distance 0.1×r (mm) apart from the surface 100 of the steel wire rod. In addition, the inner area 11 is an area enclosed by the boundary (line in the C cross section) of the distance 0.1×r (mm) apart from the surface 100 of the steel wire rod and including a center (center line) 101 of the wire rod. Moreover, as shown in FIG. 2C, a "center portion" 12 is defined as an area (hatched area) enclosed by a boundary (circle in the C cross section) of a distance 0.5×r (mm) apart from the center (center line) 101 of the wire rod and including the center 101 of the wire rod. The center portion 12 is included in the inner portion 11. As shown in FIG. 2D, the C cross section is a cross section (hatched area) perpendicular to a longitudinal direction of the wire rod, and the center line (center) 101 extends to the longitudinal direction of the wire rod.

First of all, the microstructure of the inner area will be described.

In hypereutectoid steel, as shown in FIG. 1, pro-eutectoid cementite 2 precipitates along prior austenite grain boundaries 1, and pearlite structures 1*a* form in areas except pro-eutectoid cementite 2. An area defined as pearlite blocks 3, i.e., an area having the same orientation of ferrite (each ferrite between cementite lamellae in pearlite) forms in each of the pearlite structures 1*a*. Furthermore, an area defined as pearlite colony 4, i.e., an area in which cementite lamellae are parallel to each other forms in the pearlite blocks 3. In FIG. 1, some pearlite blocks 3 are omitted.

When structures except pearlite area 10% or more and/or martensite is present as a supercooled structure in the inner area, a wire is broken because the amount of elongation of each structure during drawing varies with the position and a non-uniform strain is caused in the drawn wire. Therefore, it is necessary that the main structure be pearlite, and the area ratio of pearlite be 90% or more. It is preferable that the area ratio of pearlite be 92% or more in order to further enhance the drawability. The upper limit of the area ratio of pearlite may be 100%, and may be 99% or 98% so that manufacturing conditions of a wire rod have higher flexibility. Here, pearlite includes degenerated pearlite. It is more preferable that pearlite in which all pearlite blocks have an equivalent circle diameter of 40 μm or less be 90% or more. Pro-eutectoid cementite does not have a specific bad effect on the drawability as long as the amount of precipitated pro-eutectoid cementite is small. However, when a large amount of pro-eutectoid cementite precipitates so as to enclose prior austenite grains, the pro-eutectoid cementite hampers the prior austenite grains from deforming during drawing, and thereby the drawability decreases. Therefore, it is necessary that the area ratio of pro-eutectoid cementite be limited to 5.0% or less in the inner area. The area ratio of pro-eutectoid cementite is preferably limited to 3.0% or less, and more preferably limited to less than 3.0% or 2.8% or less in order to more consistently secure the drawability. The structures (the balance) except pearlite and pro-eutectoid cementite are at least one selected from the group consisting of bainite, ferrite, and spheroidal cementite, and it is necessary to limit the area ratio of the balance to 10% or less. The area ratio of the balance is preferably limited to 8.0% or less, and more preferably limited to less than 5.0% or 3.0% or less in order to more consistently secure the drawability.

Thus, in the embodiment, a small amount of pro-eutectoid cementite is allowed to precipitate, but it is desirable that pro-eutectoid cementite does not precipitate, unlike the above-described Patent Document 2.

The diameter (grain size) of pearlite blocks has a very strong correlation with ductility, and when the grain size of pearlite blocks is reduced, the drawability is improved. In particular, the grain size of pearlite blocks is coarse, the pearlite blocks increase the possibility that internal cracks appear during drawing, and the drawn wire is broken. Therefore, it is important to limit the grain size of pearlite blocks so as not to be excessively large. Accordingly, the maximum grain size of pearlite blocks is limited to 40 μm or less in order to improve the drawability sufficiently by inhibiting internal cracks from appearing. That is, it is necessary that the area ratio of pearlite blocks having an equivalent circle diameter of more than 40 μm be 0.62% or less. In addition, it is more preferable that the maximum grain size of pearlite blocks be limited to 35 μm or less. That is, it is more preferable that the area ratio of pearlite blocks having an equivalent circle diameter of more than 35 μm or less be 0.48% or less.

Next, the structure of the surface area will be described.

Figure 3:
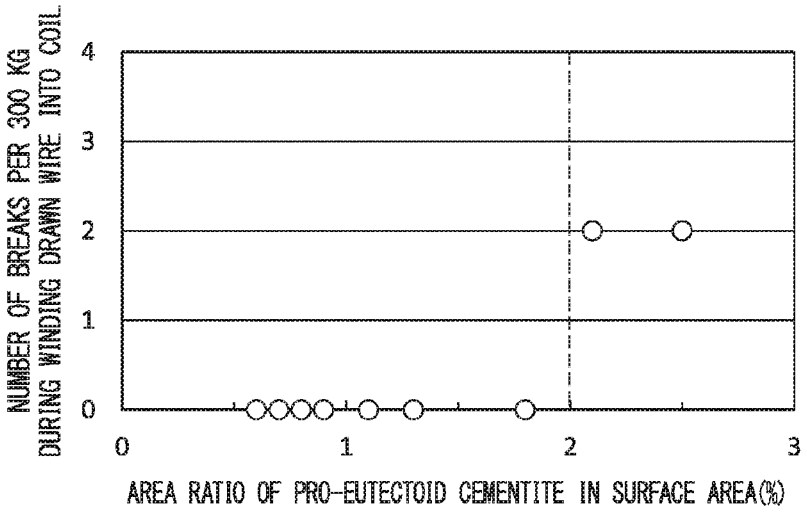
FIG. 3 is a graph showing the relationship between the area ratio of pro-eutectoid cementite in a surface area and coil formability of a drawn wire.

When a drawn wire is formed into a coil, flexure and torsion are applied to the drawn wire. Since the extent of deformation caused by the flexure and torsion is the largest in the surface area, it is important to control the microstructure (the amount of pearlite, the amount of pro-eutectoid cementite, hardness, and difference in hardness between the surface area and a center portion) in the surface area. For example, when the amount of pearlite is small, the wire breaking occurs during winding the drawn wire into a coil. In addition, for example, as shown in FIG. 3, when the amount of pro-eutectoid cementite is large and a network pro-eutectoid cementite exists, the wire breaking occurs during winding the drawn wire into a coil. Therefore, it is necessary that the area ratio of pearlite be 80% or more and the area ratio of pro-eutectoid cementite be limited to 2.0% or less in the surface area in order to secure the coil formability. The area ratio of pearlite in the surface area is preferably 85% or more or 90% or more, and more preferably more than 95% or 97% or more in order to further enhance the coil formability. Here, pearlite includes degenerated pearlite. The structures (the balance) except pearlite and pro-eutectoid cementite are at least one selected from the group consisting of bainite, ferrite, and spheroidal cementite, and it is necessary to limit the area ratio of the balance to 20% or less. The area ratio of the balance is preferably limited to 15% or less or 10% or less, and more preferably limited to less than 5.0% or 3.0% or less in order to more stably secure the coil formability.

Figure 4:
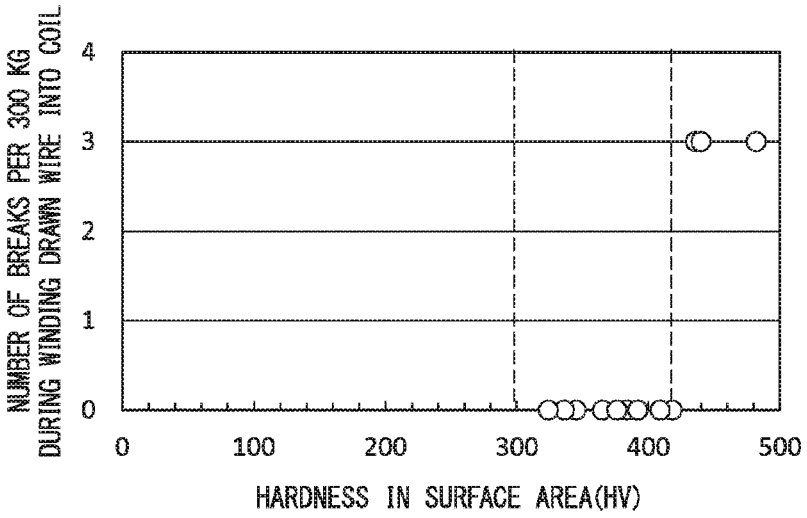
FIG. 4 is a graph showing the relationship between the hardness in a surface area and coil formability of a drawn wire.

In addition, the coil formability is influenced by, for example, the amount of Si included in ferrite in pearlite, the lamellar spacing of pearlite, the diameter (grain size) of pearlite blocks, the amount of degenerated pearlite in pearlite, the shape of cementite, the amount of inclusions, the amount of chemical elements (solutes) in a state of boundary segregation, and the grain size of prior austenite as well as the amount of pearlite, the amount of pro-eutectoid cementite, the structures of the balance, and the amount of the balance as described in the above description. For example, when a nonuniform strain is caused by the difference in elongation between a structure surrounding degenerated pearlite and the degenerated pearlite in which lamellar cementite in pearlite has a granular shape, the coil formability may decrease. However, since it is difficult to define and measure factors other than the amount of pearlite, the amount of pro-eutectoid cementite, the structures of the balance, and the amount of the balance, a factor according to a microstructure including the above-described factors which have an influence on the coil formability is defined as hardness in a surface area. When the hardness in a surface area is more than HV 420, a wire breaking occurs during winding of the drawn wire into a coil. Therefore, as shown in FIG. 4, it is necessary that the hardness be HV 420 or higher in a surface area from the surface of a wire rod to a depth 0.1×r (mm) (r: radius of the steel wire rod). On the other hand, when the hardness is less than HV 300 in a surface area, it is difficult to obtain a sufficient amount of pearlite structure and the grain size of prior austenite and pearlite blocks increases. As a result, the drawability decreases. Therefore, it is necessary that the lower limit of the hardness be HV 300 or more (Vickers hardness) in a surface area. Accordingly, the range of the hardness in a surface area is HV 300 to HV 420.

Figure 5:
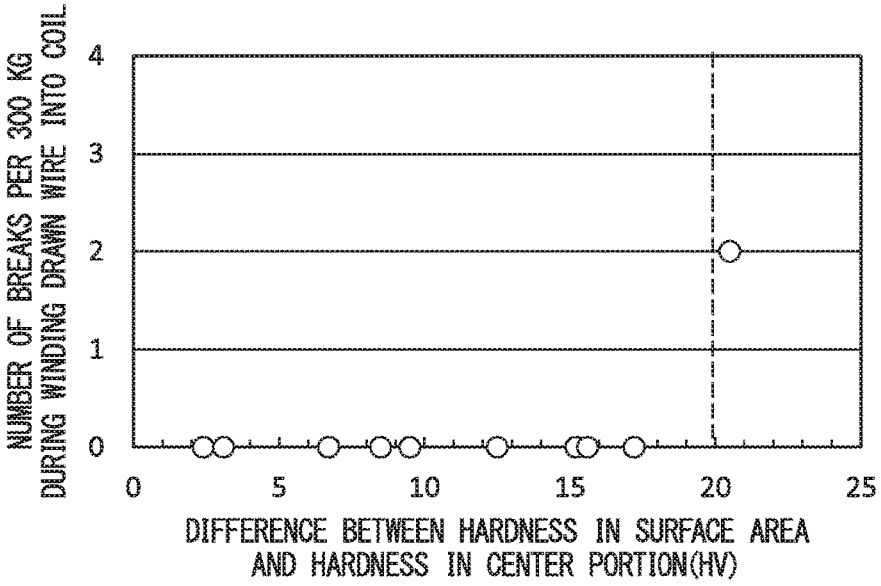
FIG. 5 is a graph showing the relationship between the difference between the hardness in a surface area and the hardness in a center portion and coil formability of a drawn wire.

Furthermore, the difference in structure between a surface area and an inner area decreases the coil formability. The structure in each position varies with, for example, chemical composition, a cooling control after hot rolling, and the microscopic distribution of chemical elements, and the difference in structure reaches a maximum between the surface of a wire rod and the center of the wire rod. Therefore, the difference between the structure in a surface area and the structure in an inner area is defined as the difference between the hardness in the surface area and the hardness in a center portion. When the difference between the hardness in a surface area and the hardness in a center portion is higher than HV 20.0, a wire breaking occurs during winding the drawn wire into a coil, as shown in FIG. 5. Therefore, it is necessary that the difference in hardness between a surface area and a center portion be limited to HV 20.0 or lower. That is, the range of the difference in hardness between a surface area and a center portion is HV 0 to HV 20.0.

The measurement method of the above-described structures will be described.

The area ratios of pro-eutectoid cementite and pearlite are measured as follows. A sample is cut out from a wire rod at an unprescribed position, is embedded in a resin, and is polished with a coarse abrasive so that the C cross section of a wire rod (a cross section perpendicular to a center line of the wire rod) is a surface (cutting surface). Next, the sample is polished with alumina for the final polish, and is etched using 3% nital solution or picral. After that, the etched surface is observed under a scanning electron microscope (SEM) in order to identify the phase and structure. Furthermore, photographic images are obtained in 10 points each of the surface area and the inner area under a magnification of 2,000-fold using the SEM (the field of the SEM per one image: 0.02 $mm^2$). Using an image analysis, the area of pro-eutectoid cementite and the area of pearlite are determined, and the area ratio of pro-eutectoid cementite and the area ratio of pearlite are calculated from the areas.

The size of pearlite blocks is measured by the following. A sample is cut out from a wire rod at an unprescribed position, is embedded in a resin, and is polished with a coarse abrasive so that the C cross section of a wire rod (a cross section perpendicular to a center line of the wire rod) is a surface (cutting surface). Next, the sample is polished with alumina and colloidal silica in order of mention for the final polish, and thereby strains are removed. After that, a field—in total it includes 200,000 $\mu m^2$ or more—is analyzed in an inner area using an electron backscatter diffraction (EBSD). It is unnecessary to set the size of one field to 200,000 $\mu m^2$, and the field may be divided into a plural number of fields. A boundary in which the difference in orientation (angle) is 9° or more is defined as a grain boundary of pearlite blocks, and the size (grain size) of pearlite blocks is measured. The size of the pearlite blocks is an equivalent circle diameter, and the size (diameter) of the largest pearlite block (grain) among the measured pearlite blocks is defined as the maximum size of pearlite blocks.

The hardness in a surface area and a center portion of a C cross section cannot be determined by the yield strength and tensile strength of a wire rod since the hardness varies with the local inner structure (the microstructure, the distribution of chemical components, and the like). Therefore, the hardness in the surface area and the hardness in the center portion are measured as follows. Three rings are continuously sampled from a wire rod wound into a ring shape, and then 24 samples having a length of about 10 mm are taken from each of eight equally-sized areas of each ring. Four samples are randomly selected from the samples, are embedded in a resin, and the resin is cut so that the C cross section of a wire rod (a cross section perpendicular to a center line of the wire rod) is a surface (cutting surface). The surface is polished with alumina to remove strains, and then the hardness in the surface area and the center portion is measured in the polished surface by a hardness test using a Vickers hardness tester.

The hardness in a surface area is determined by calculating the average of the results measured at three points or more in a range of 0.1×r (mm) from the surface of a wire rod. For example, four points are selected from a surface area in a C cross section of one sample at an equal interval (90° interval), and the hardness is measured at the four points. In this case, the measurement is applied to the other three samples. As a result, the hardness is measured at a total of 16 points (in 16 areas) per a wire rod, and the hardness in the surface area is determined by calculating the average of the hardness values at each of the 16 points.

The hardness in a center portion is determined by calculating the average of the results measured at three points or more in a range of 0.5×r (mm) from the center (center line) of a sample in the same C cross section as the C cross section in which the hardness in the surface area is determined. The difference between the hardness in the surface area and the hardness in the center portion is determined by calculating the absolute value of a number given by subtracting the hardness in the center portion from the hardness in the surface area. For example, three points (a total of 12 points) are selected from a center portion in the same C cross section as the C cross section in which the hardness in the surface area is determined, and the hardness is measured at each point. After that, the hardness in the center portion is determined by calculating the average of the hardness values at the 12 points. The difference between the hardness in the surface area and the hardness in the center portion is obtained by subtracting the hardness in the center portion from the above-described hardness in the surface area.

When the hardness is measured in an area using a Vickers hardness tester, an indentation left in the area may affect other hardness values in other areas. Therefore, measurement points are individually spaced so that the distance between measurement points is five or more times longer than the size of an indentation. In addition, when the hardness in a surface area is measured, the load of a Vickers hardness tester and measurement areas are selected so that the distance from the surface of a wire rod to a measurement area is three or more times longer than the size of an indentation.

The diameter of a wire rod according to the embodiment is not limited in particular. The diameter of the wire rod is desirably 3.5 mm to 5.5 mm, and more desirably 4.0 mm to 5.5 mm in view of the productivity of the wire rod and the productivity of bearing parts such as a steel ball of a ball bearing and a roller of a roller bearing. The diameter of the wire rod is defined by an equivalent circle diameter.

Next, a method for manufacturing a wire rod will be described. The following method is an example of methods for manufacturing a steel wire rod for bearings having excellent drawability and excellent coil formability after drawing. The method for manufacturing a steel wire rod according to the present invention is not limited by the following steps and methods. Various methods can be adopted as a method for manufacturing a steel wire rod for bearings as long as the methods work as a method for manufacturing a steel wire rod for bearings according to the present invention.

A steel piece obtained under common conditions for manufacturing (for example, casting condition and soaking condition) can be used as a starting material for hot rolling (wire rod rolling). For example, a soaking treatment (heat treatment for decreasing segregation caused during casting or the like) is applied to a cast piece obtained by casting steel having the above-described chemical composition. In the soaking treatment, the cast piece is kept for 10 to 20 hours in a temperature range of 1100 to 1200° C. A steel piece (steel piece before rod rolling which is generally called billet) is manufactured from the cast piece by blooming so as to have a size feasible for rod rolling. Applying the above-described soaking treatment to the cast piece is advantageous in stably securing the above-described microstructure in a wire rod.

After that, the steel piece is heated to a temperature range of 900 to 1300° C., and then the steel piece is rolled under a condition in which the temperature of the steel piece is controlled during rolling. In the rolling, a finish rolling starts from a temperature range of 700 to 850° C. In this case, since the temperature of the steel piece increases during finish rolling, the steel piece usually reaches a temperature range of 800 to 1000° C. when the finish rolling is completed. The temperature of the rolled wire rod is measured during rolling using a radiation thermometer, and means a surface temperature of the steel material, strictly speaking. The hot-rolled wire rod is cooled so that the average cooling rate is 5 to 20° C./s in a temperature range from a temperature immediately after the finish rolling, i.e., a temperature immediately after the hot rolling to 700° C. After that, the hot-rolled wire rod is cooled under a condition in which the cooling rate is adjusted so that the average cooling rate is 0.1 to 1° C./s in a temperature range from 700° C. to 650° C. and the temperature range of pearlite transformation is a range of 650 to 700° C. The temperature at which the cooling rate is changed is not specifically limited. The cooling rate may be changed at about 700° C., and may be changed continuously (gradually) to 650° C. after hot rolling, as long as the average cooling rate in each of the above-described temperature ranges is maintained. In addition, the hot rolled wire rod is wound during cooling in a winding temperature of 700° C. or more.

The finish rolling starts from a temperature range of 850° C. or lower in order to decrease the size of pearlite blocks by decreasing the size of austenite grains to increase the nucleation sites of pearlite during a transformation. When the finish rolling starts from a temperature range of higher than 850° C., the size of pearlite blocks is not small enough. Therefore, the finish rolling starts from a temperature range of 850° C. or lower. It is more preferable that the finish rolling start from 800° C. or lower in order to further decrease the size of pearlite blocks. On the other hand, when the finish rolling starts from a temperature range of less than 700° C., the work load in an equipment increases during rolling. In addition, the surface area of the wire rod is cooled excessively, and thereby cracks and/or abnormal structures are formed in the surface area. As a result, the drawability and coil formability of the wire rod may decrease. Therefore, the finish rolling starts from a temperature range of 700° C. or higher. It is more preferable that the finish rolling start from 750° C. or higher in order to more consistently control the microstructure in the surface area of the wire rod.

When the average cooling rate is 5° C./s or higher in a temperature range of 700° C. or higher, it is possible to inhibit the precipitation of pro-eutectoid cementite and the formation of spheroidal cementite, and it is possible to inhibit austenite grains refined by the finish rolling from growing with generation of processing heat (increase in temperature) during the finish rolling. When the size of austenite grains increases, the size of pearlite blocks increases, and variations in hardness increases. Therefore, it is necessary that the average cooling rate be 5° C./s or higher in a temperature range of 700° C. or higher in order to decrease the amount of pro-eutectoid cementite in the surface area sufficiently and more consistently secure fine pearlite blocks and uniform hardness in a C cross section. On the other hand, when the average cooling rate is higher than 20° C./s at a temperature range of 700° C. or higher, the manufacturing cost increases with an increase in facility cost, and the coil formability decreases with an increase in hardness in the surface area. Therefore, it is necessary that the upper limit of the average cooling rate be 20° C./s. It is preferable that the average cooling rate be 15° C./s or lower in order to further decrease the hardness in the surface area. When the wire rod is wound into a ring shape at a temperature range of less than 700° C., flaws tend to form on the surface of the wire rod. Therefore, the wire rod is wound at 700° C. or higher.

When the hot-rolled wire rod is cooled to 700° C. at an average cooling rate of 5 to 20° C./s, and then the hot-rolled wire rod is cooled to a temperature range of 700° C. or lower, austenite is transformed to pearlite. Therefore, the average cooling rate in a temperature range of 700° C. or lower is a factor for controlling the pearlite transformation temperature. When the average cooling rate is higher than 1.0° C./s, the pearlite transformation temperature decreases to lower than 650° C. As a result, the drawability and coil formability after drawing decrease because the hardness increases in a surface area and/or the difference in hardness between a surface area and a center portion increases. Therefore, it is necessary that the average cooling rate be 1.0° C./s or lower in a temperature range of 650 to 700° C. It is preferable that the average cooling rate be 0.8° C./s or lower in order to further improve the drawability and coil formability. When the winding temperature is 700° C. or higher and the average cooling rate is 1.0° C./s or lower, pearlite transformation has already finished at 650° C., and therefore the control of cooling rate continues to 650° C. On the other hand, when the average cooling rate is excessively low, a lot of network pro-eutectoid cementite precipitates on prior austenite grain boundaries, and thereby the drawability decreases. Therefore, it is necessary that the lower limit of the average cooling rate be 0.1° C./s or higher in order to limit the area ratio (amount of precipitation) of pro-eutectoid cementite to 5% or less in an inner area. It is preferable that the average cooling rate be 0.3° C./s or higher in order to further decrease the amount of pro-eutectoid cementite in the inner area.

When the above-described method for manufacturing is applied to a material having a chemical composition described in the embodiment, it is possible to manufacture a steel wire rod for bearings according to the present invention without performing a spheroidizing annealing on a hot-rolled wire rod. Patenting may be applied to the hot rolled wire rod as a heat treatment.

As described above, in the method for manufacturing a wire rod in the embodiment, a cast piece is obtained by casting steel consisting of, by mass percentage, C: 0.95-1.10%, Si: 0.10-0.70%, Mn: 0.20-1.20%, Cr: 0.90-1.60%, optionally, Mo: 0.25% or less and B: 25 ppm or less, and the balance of Fe and unavoidable impurities. A steel piece is obtained by blooming the cast piece. A hot-rolled wire rod is obtained by heating the steel piece to 900 to 1300° C. and hot rolling the steel piece so that the finish rolling starts from a temperature range of 700 to 850° C. The hot-rolled wire rod is wound and cooled under a condition in which the average cooling rate is 5 to 20° C./s in a temperature range from a temperature at which the hot rolling is completed to 700° C., the average cooling rate is 0.1 to 1° C./s in a temperature range from 650 to 700° C., and a temperature at which the winding is completed is 700 to 820° C.

EXAMPLES

Hereinafter, regarding a steel wire rod for bearings having excellent drawability and excellent coil formability after drawing according to the present invention, examples of the present invention will be shown and described in detail. However, the present invention is not limited by the following examples. The following examples can be modified appropriately as long as the modified examples are well suited to the purpose of the present invention. Such modified examples are included in the technical scope of the present invention.

Table 1 and Table 2 show the amounts of chemical components (elements) in wire rods, the microstructures of the wire rods, the drawability, and the coil formability after drawing.

In the present examples, samples were prepared by hot rolling and subsequent cooling steel including chemical components shown in Table 1 so as to be controlled to have a pearlite structure.

The basic method for manufacturing the wire rods according to the present examples is as follows, and partial or overall modification was made to the basic method in some steel wire rods. A billet was heated to 1000 to 1200° C. in a heating furnace, and then was hot rolled so that the finish rolling started from a temperature range of 700 to 800° C. After that, the cooling condition was controlled step by step as follows: the average cooling rate was 5 to 20° C./s in a temperature range from a temperature at which the hot rolling was completed to 700° C., the average cooling rate was 0.1 to 1° C./s in a temperature range from 650 to 700° C., and the pearlite transformation temperature was 650 to 700° C. The diameters of the wire rods were 3.6 to 5.5 mm.

In the wire rods of Nos. 15 to 21, the following partial modification was made to the above-described basic method. In addition, in the wire rod of No. 22, the above-described basic method was not used, but the following method was used instead. That is, a hot-rolled wire rod having a grain size number of austenite of 9.5 and a diameter of wire rod of 3.0 mm was obtained by controlling the hot rolling conditions of a billet. After that, the obtained hot-rolled wire rod was cooled to 650° C. at a constant cooling rate of 9° C./s, and then was cooled to from 650° C. to 400° C. at a constant rate of 1.0° C./s so as to have a lamellar spacing of pearlite of 0.08 μm.

The area ratio of pro-eutectoid cementite and the area ratio of pearlite were determined in a surface area (area in a range of a depth 0.1×r (mm) from the surface of a wire rod (r: radius of the steel wire rod)) and an inner area (area other than the surface area), and then the maximum size of pearlite blocks was determined in the inner area.

The obtained wire rod was embedded in a resin, and was polished with a coarse abrasive so that the C cross section of the wire rod was a surface. The surface was polished with alumina for the final polish, and then was etched using 3% nital and or picral. After that, the phase and structure were identified by an observation using a SEM, and the area ratios of pro-eutectoid cementite and pearlite were measured using photographic SEM images.

The area ratios of pro-eutectoid cementite and pearlite were measured as follows. The photographic images were obtained in 10 points each of the surface area and the inner area under a magnification of 2,000-fold (the total area of the field per one image: 0.02 $mm^2$). Using an image analysis, the area of pro-eutectoid cementite and the area of pearlite were determined in the obtained images, and then the area ratios of pro-eutectoid cementite and pearlite were calculated from the areas. As a result, the area ratios of pro-eutectoid cementite and pearlite were obtained both in the surface area and in the inner area.

The maximum size of pearlite blocks was measured using an electron backscatter diffraction (EBSD) analysis equipment. The obtained wire rod was embedded in a resin, and was polished with a coarse abrasive so that the C cross section of a wire rod was a surface. The surface was polished with alumina and colloidal silica in order of mention for the final polish, and thereby strains were removed. Pearlite blocks in the polished surface were measured in four areas (the total area of the fields: 200,000 $\mu m^2$), each having an area of 50,000 $\mu m^2$, using the EBSD. A boundary in which the difference in orientation was 9° or more was regarded as a grain boundary of a pearlite block in the field, and the size of pearlite blocks was measured. It was determined that the maximum size of pearlite blocks was the largest size of pearlite block (grain) among the sizes of the measured pearlite blocks.

The hardness in a surface area was measured as follows. Three rings were sampled from the obtained wire rod, and then eight samples having a length of 10 mm were taken from each of eight equally-sized areas of each ring (8 sampling points equally spaced). From the total of 24 samples, four samples were selected randomly. The selected samples were embedded in a resin, and were polished with a coarse abrasive so that the C cross section of the wire rod was a surface. Furthermore, the samples were polished with alumina for the final polish, and thereby strains were removed from the polished surface. After that, four points were selected from a surface area in a C cross section of one sample at an equal interval (90° interval), and the hardness was measured at the four points. In addition, the measurement was applied to the other three samples. As a result, the hardness was measured at a total of 16 points per one wire rod, and the hardness in the surface area of the wire rod was determined by calculating the average of the hardness values at the 16 points. When the hardness in the surface area was measured, the load of a Vickers hardness tester and measurement areas were selected so that the distance from the surface of the wire rod to a measurement area was three times the size of an indentation.

After that, the difference in hardness between a surface area and a center portion was determined by a method similar to the above-described method for measuring the hardness in the surface area. Three points were selected from a center portion (an area in a range of 0.5×r (mm) from a center) in the same C cross section as the C cross section in which the hardness in the surface area was determined, and the hardness was measured at each point. The hardness in the center portion was determined by calculating the average of the hardness values obtained at the 12 points. The difference between the hardness in the surface area and the hardness in the center portion was obtained by subtracting the hardness in the center portion from the above-described hardness in the surface area.

Next, a test for determining the drawability will be described. The obtained wire rod was pickled in order to remove scales without subjecting the wire rod to spheroidizing annealing, and was bonderized and coated with a lime film in order to make a lubrication film. After that, a test for determining the drawability of the wire rod was performed. In this test, a 25 meters of wire rod was sampled from the wire rod, and was drawn at a drawing speed of 50 m/min using a dry type single head drawing machine so that the reduction in area is 20% per 1 pass. The drawing was repeated until the wire breaking occurred. The true strain ($-2\times Ln(d/d_0)$) (d: the diameter of the drawn wire, $d_0$: the diameter of the steel wire rod) was calculated from the diameter of the broken drawn wire. The true strain was measured five times, and the average of the 5 true strain values was defined as breaking strain (drawing limit strain).

Moreover, a test for determining the coil formability will be described. The test was applied to wire rods which had a drawing limit strain of 1.8 or higher in the above-described test for determining the drawability. A 300 kg of wire rod was sampled from the wire rod, and then the wire rod was pickled in order to remove scales without subjecting the wire rod to spheroidizing annealing. In addition, the wire rod was bonderized and coated with a lime film in order to make a lubrication film. After that, the wire rod was drawn at a final drawing speed of 150 to 300 m/min using a dry type continuous cumulative drawing machine so that the reduction in area is 17 to 23% per 1 pass and the total reduction in area is 70% or higher. The drawn wire was continuously wound into a coil. While the drawn wire was being wound, the wire was examined for breaks, and the coil formability was determined by the number of breaks per 300 kg. The diameter of the coil was 600 mm.

TABLE 1

| | ELEMENTS (MASS %) | | | | | | | | | | |
|---|---|---|---|---|---|---|---|---|---|---|---|
| No. | C | Si | Mn | Cr | P | S | Al | N | O | Mo | B (ppm) |
| 1 | 1.01 | 0.25 | 0.35 | 1.36 | 0.007 | 0.005 | 0.012 | 0.005 | 0.0007 | — | — |
| 2 | | | | | | | | | | | |
| 3 | 1.00 | 0.26 | 0.34 | 1.40 | 0.004 | 0.006 | 0.015 | 0.011 | 0.0008 | — | — |
| 4 | | | | | | | | | | | |
| 5 | 0.97 | 0.20 | 0.23 | 1.05 | 0.010 | 0.009 | 0.021 | 0.015 | 0.0006 | 0.05 | 1 |
| 6 | 0.97 | 0.12 | 0.23 | 0.91 | 0.010 | 0.009 | 0.019 | 0.021 | 0.0006 | 0.05 | 1 |
| 7 | 1.00 | 0.25 | 0.40 | 1.41 | 0.004 | 0.005 | 0.022 | 0.014 | 0.0008 | 0.23 | — |
| 8 | 1.01 | 0.24 | 0.28 | 1.38 | 0.008 | 0.008 | 0.018 | 0.011 | 0.0009 | — | 21 |
| 9 | 1.00 | 0.26 | 0.34 | 1.40 | 0.004 | 0.006 | 0.015 | 0.011 | 0.0008 | — | — |
| 10 | 1.20 | 0.60 | 0.28 | 1.43 | 0.006 | 0.006 | 0.018 | 0.011 | 0.0008 | — | — |

TABLE 1-continued

| No. | ELEMENTS (MASS %) C | Si | Mn | Cr | P | S | Al | N | O | Mo | B (ppm) |
|---|---|---|---|---|---|---|---|---|---|---|---|
| 11 | 1.06 | 0.83 | 0.29 | 1.35 | 0.008 | 0.005 | 0.020 | 0.009 | 0.0007 | 0.05 | — |
| 12 | 0.96 | 0.18 | 1.56 | 1.40 | 0.007 | 0.002 | 0.019 | 0.013 | 0.0008 | — | 2 |
| 13 | 1.05 | 0.50 | 0.23 | 1.63 | 0.011 | 0.008 | 0.015 | 0.012 | 0.0008 | — | — |
| 14 | 0.96 | 0.25 | 0.34 | 1.40 | 0.006 | 0.010 | 0.014 | 0.011 | 0.0006 | 0.38 | — |
| 15 | 1.01 | 0.25 | 0.35 | 1.36 | 0.007 | 0.005 | 0.012 | 0.005 | 0.0007 | — | — |
| 16 | | | | | | | | | | | |
| 17 | | | | | | | | | | | |
| 18 | 1.00 | 0.26 | 0.34 | 1.40 | 0.004 | 0.006 | 0.015 | 0.011 | 0.0008 | — | — |
| 19 | | | | | | | | | | | |
| 20 | | | | | | | | | | | |
| 21 | | | | | | | | | | | |
| 22 | 1.01 | 0.25 | 0.35 | 1.36 | 0.007 | 0.005 | 0.012 | 0.005 | 0.0007 | — | — |

TABLE 2

| No. | ROD DIAMETER (mm) | MICROSTRUCTURE | SURFACE AREA HARDNESS (HV) | SURFACE AREA AREA RATIO OF PRO-EUTECTOID θ (%) | SURFACE AREA AREA RATIO OF PEARLITE (%) | INNER AREA MAXIMUM GRAIN SIZE (μm) | INNER AREA AREA RATIO OF COARSE GRAINS (%) | INNER AREA AREA RATIO OF PRO-EUTECTOID θ (%) | INNER AREA AREA RATIO OF PEARLITE (%) | DIFFERENCE IN HARDNESS BETWEEN SURFACE AREA AND CENTER PORTION (ΔHV) | BREAKING STRAIN | COIL FORMABILITY |
|---|---|---|---|---|---|---|---|---|---|---|---|---|
| 1 | 4.0 | P + θ | 345 | 1.3 | 94.3 | 29.9 | 0.00 | 2.8 | 95.3 | 8.5 | 3.2 | 0 |
| 2 | 5.5 | P + θ | 418 | 0.8 | 95.4 | 18.0 | 0.00 | 1.6 | 96.2 | 2.4 | 2.8 | 0 |
| 3 | 4.0 | P + θ | 384 | 1.1 | 98.4 | 25.3 | 0.00 | 2.2 | 96.0 | 12.5 | 3.0 | 0 |
| 4 | 5.0 | P + θ | 336 | 1.8 | 87.6 | 31.0 | 0.00 | 4.2 | 92.6 | 9.5 | 2.8 | 0 |
| 5 | 4.0 | P + θ | 324 | 1.1 | 96.3 | 29.0 | 0.00 | 3.6 | 93.9 | 17.2 | 3.0 | 0 |
| 6 | 5.0 | P + θ | 365 | 0.8 | 97.7 | 32.1 | 0.00 | 1.3 | 95.2 | 6.7 | 3.0 | 0 |
| 7 | 5.5 | P + θ | 376 | 0.7 | 96.8 | 27.1 | 0.00 | 4.1 | 90.8 | 15.2 | 3.2 | 0 |
| 8 | 4.0 | P + θ | 392 | 0.6 | 98.8 | 29.7 | 0.00 | 0.6 | 97.6 | 3.1 | 2.8 | 0 |
| 9 | 3.6 | P + θ | 409 | 0.9 | 97.3 | 19.8 | 0.00 | 1.5 | 97.7 | 15.6 | 3.2 | 0 |
| 10 | 4.0 | P + θ | 386 | 2.1 | 97.3 | 29.3 | 0.00 | 6.3 | 92.5 | 2.0 | 1.8 | 2 |
| 11 | 4.0 | P + θ | 436 | 1.0 | 98.1 | 30.6 | 0.00 | 1.1 | 94.2 | 14.1 | 2.5 | 3 |
| 12 | 5.5 | P + θ +M | 395 | 1.3 | 94.3 | 25.5 | 0.00 | 2.4 | 87.5 | 13.9 | 0.5 | — |
| 13 | 5.5 | P + θ +M | 409 | 1.4 | 85.6 | 20.0 | 0.00 | 1.4 | 84.3 | 7.7 | 0.2 | — |
| 14 | 5.5 | P + θ +M | 416 | 1.0 | 95.6 | 23.5 | 0.00 | 1.0 | 90.8 | 11.9 | 0.5 | — |
| 15 | 5.5 | P + θ | 326 | 2.5 | 90.6 | 28.2 | 0.00 | 3.4 | 92.4 | 19.1 | 2.8 | 2 |
| 16 | 5.5 | P + θ | 440 | 0.1 | 98.4 | 20.9 | 0.00 | 1.3 | 97.3 | 16.5 | 3 | 3 |
| 17 | 5.5 | P + θ | 342 | 1.4 | 94.6 | 41.6 | 0.68 | 3.9 | 91.8 | 6.8 | 1.5 | — |
| 18 | 4.0 | P + θ | 316 | 1.8 | 76.5 | 31.2 | 0.00 | 4.1 | 92.1 | 4.6 | 2.5 | 1 |
| 19 | 4.0 | P + θ | 336 | 2.1 | 82.6 | 24.9 | 0.00 | 3.1 | 93.5 | 3.0 | 3 | 2 |
| 20 | 4.0 | P + θ | 354 | 1.4 | 90.3 | 30.4 | 0.00 | 5.8 | 88.4 | 11.9 | 2 | 2 |
| 21 | 4.0 | P + θ | 386 | 1.1 | 92.5 | 24.7 | 0.00 | 1.9 | 94.8 | 20.5 | 2.8 | 2 |
| 22 | 3.0 | P | 482 | 0 | 98.9 | 18.5 | 0.00 | 0.0 | 98.6 | 19.8 | 2.8 | 3 |

The results are shown in Table 2. When a value in a cell is outside the scope of the present invention, the value in the cell is underlined. P means pearlite, θ means pro-eutectoid cementite, and M means martensite in a column labeled as "MICROSTRUCTURE" in Table 2. Ferrite, spheroidal cementite, and bainite were observed in addition to the structures shown in the column. In Table 2, the "MAXIMUM GRAIN SIZE" is the maximum grain size of pearlite blocks, and the "AREA RATIO OF COARSE GRAINS" is the area ratio of pearlite blocks having an equivalent circle diameter of more than 40 μm in the microstructure. Regarding the "COIL FORMABILITY" in Table 2, the numbers are the number of times to break, and a symbol "-" indicates that the test was not performed.

The wire rods of Nos. 1 to 9 are inventive examples. In these wire rods, the wire breaking did not occur even when a true strain of 2.8 or higher was applied to the wire rods, and therefore the wire rods had excellent drawability. In addition, the drawn wires of Nos. 1 to 9 were wound into a coil without breaking even when the wire rods were drawn so that the total reduction in area is 70% or higher, and therefore the wire rods had excellent coil formability.

The wire rods of Nos. 10 to 14 are comparative examples. The chemical compositions of these wire rods were different from the range of chemical composition of the wire rod according to the present invention. In the wire rod of No. 10, because the amount of C was large, pro-eutectoid cementite precipitated excessively in a surface area and other areas, and thereby the drawability and coil formability were degraded. In the wire rod of No. 11, because the amount of Si was large, the hardness was excessively high in a surface area, and thereby the coil formability was degraded. In the wire rods of Nos. 12 to 14, the amount of Mn, Cr, or Mo was large, the wire rods included martensite, and thereby the drawability was degraded.

The wire rods of Nos. 15 to 21 are comparative examples. These wire rods had a chemical composition of the wire rod according to the present invention, but had a microstructure different from a microstructure of the wire rod according to the present invention. In the wire rods of Nos. 15 and 19, because the average cooling rate was lower than 5° C./s from the completion of finish rolling to 700° C., pro-eutectoid cementite precipitated excessively in a surface area, and thereby the coil formability was degraded. In the wire rod of No. 16, the wire rod was cooled rapidly at an average cooling rate of higher than 1.0° C./s in a temperature range of 650 to 700° C., and thereby the transformation temperature decreased to lower than 650° C. As a result, in the wire rod of No. 16, the hardness was excessively high in a surface area, and thereby the coil formability was degraded. In the wire rod of No. 17, because the finish rolling started from a temperature of higher than 850° C., the size of pearlite blocks increased, and thereby the drawability was degraded. In addition, in the wire rod of No. 17, the area ratio of pearlite blocks having an equivalent circle diameter of more than 40 m was higher than 0.62%. In the wire rod of No. 18, because the finish rolling started from a temperature of lower than 700° C., cementite was spheroidized in degenerated pearlite and pearlite, and spheroidal cementite formed in a surface area. As a result, in the wire rod of No. 18, the formation of spheroidal cementite decreased the area ratio of pearlite in the surface area, and thereby the coil formability was degraded. In the wire rod of No. 20, the wire rod was cooled rapidly to 700° C. after the completion of finish rolling, but the average cooling rate was lower than 0.1° C./s in a temperature range of 650 to 700° C. Therefore, in the wire rod of No. 20, the excessive precipitation of pro-eutectoid cementite decreased the area ratio of pearlite in an area other than a surface area, and thereby the drawability was degraded. In the wire rod of No. 21, because the average cooling rate was higher than 1.0° C./s (a constant rate) in a temperature range of 650 to 700° C., the difference in hardness between a surface area and a center portion increased to HV 20 or higher, and thereby the coil formability was degraded. The wire rod of No. 22 had a pearlite single phase structure in which the amount of pro-eutectoid cementite was 0% and the lamellar spacing was 0.08 μm. However, in the wire rod of No. 22, the hardness was excessively high in a surface area, and thereby the coil formability was degraded.

INDUSTRIAL APPLICABILITY

It is possible to provide a steel wire rod for bearings having excellent drawability and excellent coil formability after drawing even when spheroidizing annealing is omitted before drawing.

BRIEF DESCRIPTION OF THE REFERENCE SYMBOLS

1: PRIOR AUSTENITE GRAIN BOUNDARY
1*a*: PEARLITE STRUCTURE
2: PRO-EUTECTOID CEMENTITE
3: PEARLITE BLOCK
4: PEARLITE COLONY
10: SURFACE AREA
11: INNER AREA
12: CENTER PORTION
100: SURFACE OF STEEL WIRE ROD
101: CENTER LINE (CENTER, CENTER AXIS)

What is claimed is:

1. A steel wire rod comprising:
C: 0.95 to 1.10 mass %,
Si: 0.10 to 0.70 mass %,
Mn: 0.20 to 1.20 mass %,
Cr: 0.90 to 1.60 mass %,
Mo: 0 to 0.25 mass %,
B: 0 to 25 ppm,
P: 0 to 0.020 mass %,
S: 0 to 0.020 mass %,
O: 0 to 0.0010 mass %,
N: 0 to 0.030 mass %,
Al: 0.010 to 0.100 mass %, and
a balance: Fe and impurities,
wherein a surface area is an area between a surface and a line 0.1 times a half of an equivalent circle diameter of the steel wire rod apart from the surface in a cross-section perpendicular to a longitudinal direction, and has a microstructure consisting of pearlite, pro-eutectoid cementite, and a balance,
wherein in the surface area, a Vickers hardness is HV 300 to 420, an area ratio of the pearlite is 80% or more, an area ratio of the pro-eutectoid cementite is 2.0% or less, and the balance is one or more selected from the group consisting of ferrite, spheroidal cementite, and bainite,
wherein an inner area is an area enclosed by the line 0.1 times the half of the equivalent circle diameter of the steel wire rod apart from the surface and including a center in the cross-section perpendicular to the longitudinal direction, and has a microstructure consisting of pearlite, pro-eutectoid cementite, and a balance,
wherein in the inner area, an area ratio of the pearlite is 90% or more, an area ratio of the pro-eutectoid cementite is 5.0% or less, the balance is one or more selected from the group consisting of ferrite, spheroidal cementite, and bainite, and an area ratio of pearlite blocks existing in the pearlite and having an equivalent circle diameter of more than 40 μm is 0.62% or less, and
wherein a center portion is an area enclosed by a line 0.5 times the half of the equivalent circle diameter of the steel wire rod apart from the center and including the center in the cross-section perpendicular to the longitudinal direction, and a difference between a Vickers hardness of the center portion and a Vickers hardness of the surface area is HV 20.0 or less.

2. The steel wire rod according to claim 1, further comprising at least one selected from the group consisting of:
Mo: 0.05 to 0.25 mass %, and
B: 1 to 25 ppm.

3. The steel wire rod according to claim 1, wherein a diameter of the steel wire rod is 3.5 mm to 5.5 mm.

4. The steel wire rod according to claim 2, wherein a rod diameter of the steel wire rod is 3.5 mm to 5.5 mm.

* * * * *